US009127534B2

(12) United States Patent
Payne

(10) Patent No.: US 9,127,534 B2
(45) Date of Patent: Sep. 8, 2015

(54) CABLE INTEGRITY MONITOR FOR ELECTROMAGNETIC TELEMETRY SYSTEMS

(75) Inventor: Richard Graham Payne, Glos (GB)

(73) Assignee: Halliburton Energy Services, Inc., Houston, TX (US)

( * ) Notice: Subject to any disclaimer, the term of this patent is extended or adjusted under 35 U.S.C. 154(b) by 855 days.

(21) Appl. No.: 11/590,271

(22) Filed: Oct. 31, 2006

(65) Prior Publication Data

US 2008/0099197 A1 May 1, 2008

(51) Int. Cl.
*E21B 47/125* (2012.01)
*E21B 47/12* (2012.01)
*E21B 41/00* (2006.01)

(52) U.S. Cl.
CPC ..... *E21B 47/12* (2013.01); *E21B 41/0021* (2013.01); *E21B 47/121* (2013.01)

(58) Field of Classification Search
USPC ..... 166/250.01, 248; 324/368, 509, 526; 702/58; 340/853.1, 853.2, 855.8, 855.9
See application file for complete search history.

(56) References Cited

U.S. PATENT DOCUMENTS 287,501 A * 10/1883 Bradley ..... 324/526
2,297,754 A * 10/1942 Ennis ..... 324/347
2,468,398 A * 4/1949 Griffin ..... 324/526
2,673,613 A * 3/1954 Irwin ..... 166/250.01
3,913,010 A * 10/1975 Scarpino ..... 324/509
4,080,642 A * 3/1978 Stolarczyk ..... 361/47
4,804,906 A * 2/1989 Hamberg et al. ..... 324/718
4,821,035 A * 4/1989 Hanson et al. ..... 340/854.5
5,886,303 A 3/1999 Rodney
6,320,820 B1 11/2001 Gardner et al.
6,547,008 B1 4/2003 Hopper et al.
6,587,037 B1 * 7/2003 Besser et al. ..... 340/854.9
6,633,164 B2 * 10/2003 Vinegar et al. ..... 324/355
6,672,407 B2 1/2004 Streich
6,712,139 B1 * 3/2004 Al-Mahrous ..... 166/250.05
6,817,412 B2 * 11/2004 Haase ..... 166/250.01
6,847,304 B1 1/2005 McLoughlin
7,064,676 B2 6/2006 Hall et al.
7,114,561 B2 * 10/2006 Vinegar et al. ..... 166/250.01
7,259,568 B2 * 8/2007 Mernyk et al. ..... 324/536
2003/0000300 A1 * 1/2003 Wong ..... 73/152.14
2003/1007221 4/2003 Macpherson
2004/0131342 A1 * 7/2004 Masino ..... 388/800

(Continued)

FOREIGN PATENT DOCUMENTS

GB 2222037 2/1990
WO WO-02/19495 A2 3/2002

OTHER PUBLICATIONS

"Rocky Mountain Oilfield Testing Center", *SAM III Project, Sandia National Laboratories, Rocky Mountain Oilfield Testing Center, U.S. Department of Energy*, (Mar. 31, 1998), 21 Pages.

(Continued)

*Primary Examiner* — Cathleen Hutchins
(74) *Attorney, Agent, or Firm* — Schwegman Lundberg & Woessner, P.A.; John W. Wustenberg

(57) ABSTRACT

In some embodiments, an apparatus and a system, as well as a method and an article, may include a signal integrity monitor that senses the signal transmitted between a surface device and a downhole device. The signal integrity monitor is adapted to disconnect power from the communication system if a fault in the communication line is detected.

15 Claims, 6 Drawing Sheets

(56) References Cited

U.S. PATENT DOCUMENTS

| | | | | |
|---|---|---|---|---|
| 2005/0046591 | A1* | 3/2005 | Pacault et al. | 340/855.2 |
| 2006/0213659 | A1* | 9/2006 | McCoy | 166/250.01 |

OTHER PUBLICATIONS

"The IntelliSery Netwrok High-Speed Drill String Telemetry Technology", *IntelliServ, A Grant Prideco Company*, (2006), 8 Pages.

Bhagwan, J., et al., "Electric drill stem telemetry", *IEEE Transactions on Geoscience and Remote Sensing*, GE-20(2), (Apr. 1982), 193-197.

Degauque, P., et al., "Propagation of electromagnetic waves along a drillstring of finite conductivity", *SPE Drilling Engineering*, 2(2), (Jun. 1987), 127-134.

Hill, D. A., et al., "Calculated admittance of an idealized drill rod antenna in a lossy medium", *IEEE Transactions on Antennas and Propagation*, 27(5), (Sep. 1979), 701-704.

Hill, D. A., et al., "Electromagnetic basis of drill-rod telemetry", *Electronics Letters*, 14(16), (Aug. 3, 1978), 532-533.

Hill, D. A., et al., "Propagation along a two-wire line located at the air-Earth interface", *IEEE Transactions on Geoscience and Remote Sensing*, 28(3), (May 1990), 400-402.

Rogers, John D., et al., "Very High-Speed Drill String Communications Network: An Enabling Technology", *Downhole Telemetry, GasTIPS*, (2003), 4-7.

Wait, James R., et al., "Theory of transmission of electromagnetic waves along a drill rod in conducting rock", *IEEE Transactions on Geoscience Electronics*, GE-17(2), (Apr. 1979), 21-24.

"United Kingdom Application No. 0721297.0, Combined Search and Examination Report dated Feb. 20, 2008", 24 pgs.

, "Australian Application Serial No. 2007231688, First Examiner Report mailed Nov. 11, 2008", 2 pgs.

0721297.0, "United Kingdom Application No. 0721297.0 ,Office Action mailed on Feb. 6, 2009", 1.

* cited by examiner

CABLE INTEGRITY MONITOR FOR ELECTROMAGNETIC TELEMETRY SYSTEMS

TECHNICAL FIELD

Various embodiments described herein relate to electromagnetic telemetry systems and methods including apparatus, systems, and methods for detecting faults in oil field electromagnetic telemetry systems.

BACKGROUND INFORMATION

During drilling and extraction operations of hydrocarbons, a variety of communication and transmission techniques have been attempted for data communications between the surface of the earth and the downhole tools. The data communications from the downhole tool to the surface may be used to provide information related to the evaluation of the formation, control of the drilling operations, etc. However, drilling, exploration, and extraction occur in remote and hostile conditions are hostile to electronic equipment and electronic communications. In some field communication schemes the signal will have significant power and if the communication channel is interrupted, then the power may cause arcing or other electromagnetic events that may be dangerous in view of the hydrocarbon extraction environment. This type of environment may be classified as a "hazardous" environment according to safety regulation authorities. See, e.g., The Dangerous Substances and Explosive Atmospheres Regulations 2002 (DSEAR) and Explosive Atmospheres Directive 99/92/EC (ATEX 137) which are enforced by the various government organizations, e.g., Petroleum Licensing Authorities, in Europe, or Underwriters Labs, National Electrical Code 500 and Canadian Services Association in North America. As a result there is a need to monitor the integrity of electronic communications between downhole and surface communication devices.

DETAILED DESCRIPTION

Figure 1:
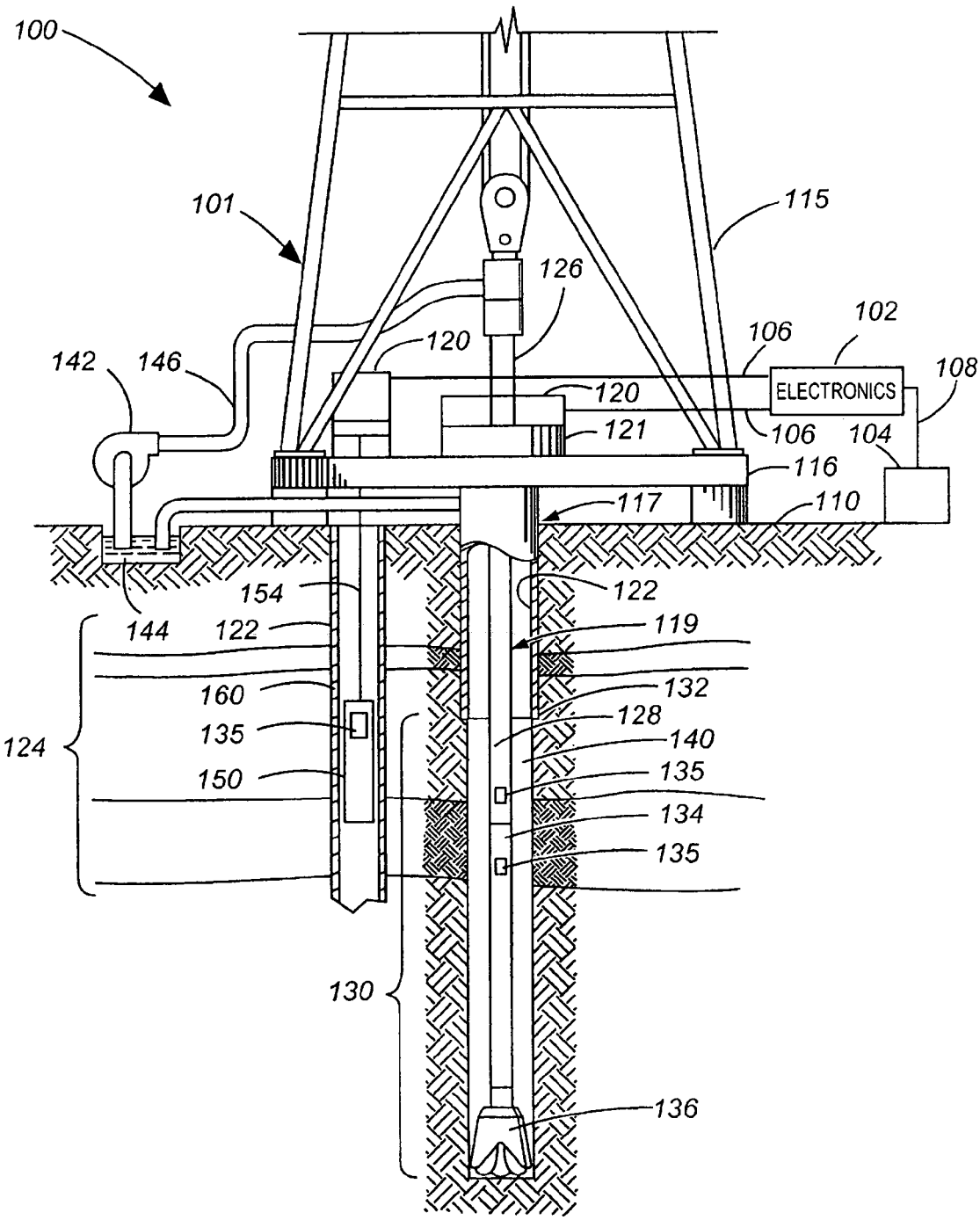
FIG. 1 is a schematic diagram of an apparatus according to various embodiments of the invention.

FIG. 1 illustrates a system 100 for the exploration, drilling, and extraction of hydrocarbons. An exploration/extraction rig structure 101 is in communication with electronics equipment 102 that in turn is in electrical communication with a grounding structure 104. In an embodiment, the electrical equipment 102 is remotely positioned relative to the rig 101 and connected by a communication line 106, such as a cable or wire. The communication line 106 may be a double core cable that has two separate signaling paths in a single constructions. The communication line 106 may be a plurality of separate, parallel signaling paths in separate lines of cables. A further communication line 108, such as a cable or wire, connects the electronics equipment 102 to the grounding structure 104. Line 108 may also be a multiple core line or a plurality of single core lines. The grounding structure 104 may be a stake embedded in the earth 110. The electronics equipment is positioned remote from the rig 101 to protect the electronics 102 from the harsh conditions of the rig site and protect the electronics 102 from damage while the rig is forming, drilling, or in other rig operations. Moreover, the electronics 102 can be mounted in a mobile platform and brought to a well site as needed. The electronics 102 may communicate with downhole devices and may be a logging facility for storage, processing, and analysis. Such a facility may be provided with electronic equipment 102 for various types of signal processing. Similar log data may be gathered and analyzed during drilling operations (e.g., during logging while drilling, measurement while drilling, seismic while drilling operations). That is, any data acquired downhole is sent to the surface via telemetry for use by the electronics 102. The term "telemetry" is used in the hydrocarbon extraction art to define a method of transmitting information from the downhole to the surface. Telemetry can be achieved by many means, for example, "hardwire," where the signal is passed along a conducting medium via electrical means and to which the downhole tool is in communication and/or attached.

Rig structure 101 includes rig support frame or derrick 115 located on a platform 116 at a surface of earth 110 of a well or subsurface formation 117. Frame 115 provides support for downhole structures such as a drill string 119 and/or a logging device 150. A drill string 119 may operate through surface level metal work such as a blowout preventer 120 to penetrate a rotary table 121 for drilling a borehole 122 through subsurface formations 124. The drill string 119 may include a Kelly 126, drill pipe 128, and a bottom hole assembly 130, perhaps located at the lower portion of the drill pipe 128. The bottom hole assembly 130 may include drill collars 132, a downhole tool 134, and a drill bit 136.

The drill bit 136 may operate to create a borehole 122 by penetrating the earth surface 110 and subsurface formations 124. The downhole tool 134 may comprise any of a number of different types of tools 135 including MWD (measurement while drilling) tools, LWD (logging while drilling) tools, seismic while drilling, magnetic resonance image logging (MRIL), and others. During drilling operations, the drill string 119 may be rotated by rotary table 121. In addition to, or alternatively, the bottom hole assembly 130 may also be rotated by a motor (e.g., a mud motor) that is located downhole. The drill collars 132 may be used to add weight to the drill bit 136. The drill collars 132 also may stiffen the bottom hole assembly 130 to allow the bottom hole assembly 130 to transfer the added weight to the drill bit 136, and in turn, assist the drill bit 136 in penetrating the surface 110 and subsurface formations 124.

During drilling operations, a mud pump 242 may pump drilling fluid (sometimes known as "drilling mud") from a mud pit 244 through a hose 246 into the drill pipe 128 and down to the drill bit 136. The drilling fluid can flow out from the drill bit 136 and be returned to the surface 110 through an annular area 140 between the drill pipe 128 and the sides of the borehole 122. The drilling fluid may then be returned to the mud pit 144, where such fluid is filtered. In some embodiments, the drilling fluid can be used to cool the drill bit 136, as well as to provide lubrication for the drill bit 136 during drilling operations. Additionally, the drilling fluid may be used to remove subsurface formation 124 cuttings created by operating the drill bit 136.

In another embodiment, the rig structure 101 is positioned over a borehole 122, which has been drilled or formed, to support a tool body 150 as part of a logging operation. Here it is assumed that the drilling string has been at least temporarily removed from the borehole 122 to allow logging tool body 150, which includes an information gathering, downhole tool 134, such as a probe or sonde, to be lowered by cable, wireline or logging cable 154 into the borehole 122. Typically, the tool body 150 is lowered to the bottom of the region of interest and subsequently pulled upward at a substantially constant speed. During the upward trip, instrument tool 134 included in the tool body 150 may be used to perform measurements on the subsurface formations adjacent the borehole as the tools pass by. In an embodiment the tool body communicates with the surface electronics 102 via a communication line, such as casing pipe 160, blowout preventer 120, and line 106.

It should also be understood that the apparatus and systems of various embodiments can be used in applications other than for drilling and logging operations, and thus, various embodiments are not to be so limited. The illustration of system 100 is intended to provide a general understanding of the structure of various embodiments, and they are not intended to serve as a complete description of all the elements and features of apparatus and systems that might make use of the structures described herein.

In operation the electronics 102 communicates via electromagnetic telemetry with downhole devices, such as those described in FIG. 1 but embodiments of the present invention are not limited to only those specifically described, using power electronics to deliver a signal via line 106 to the metal work extending downhole. The metal work in an example include the drill string 119. In a further example, the metal work includes the casing pipes 160 or other tubes extending below ground. The electronics may produce a carrier signal on which data is carried for example via modulation techniques. Examples of downhole telemetry are discussed in "Electric Drill Stem Telemetry" by J. Bhagwan and F. N. Trofimenkoff, IEEE Transactions on Geoscience and Remote Sensing, Vol. GE-20, No. 2, April 1982; "Propagation of electromagnetic Waves Along a Drillstring of Finite Conductivity" P. DeGauque and R. Grudzinski, SPE Drilling Engineering, June 1987; "Electromagnetic Basis of Drill-Rod Telemetry" by D. A. Hill and J. R. Wait, Electron. Letters Vol. 14, pages 532-533; and "Theory of Transmission of electromagnetic Waves Along a Drill Rod in Conducting Rock", J. R. Wait and D. A. Hill, IEEE Transactions on Geoscience Electronics, Vol. GE-17, No. 2, April 1979. Each of these documents are hereby incorporated by reference for any purpose. The signal travels through the line 106 and metal work below ground where it is received by downhole tools 135. The downhole tools 135 may also transmit data created during hydrocarbon exploration and extraction activities though the downhole metal work to the surface electronics 102. In an example, the signal is a low frequency analog signal such that the signal can travel the length of the downhole metal work to reach a downhole tool. In an example, the signal is a sinusoidal signal having a frequency in a range of just over 0 Hz to about 250 kHz. However, such a low frequency signal would still require significant power from about 1 kilowatt and up. In an embodiment the power of the signal is about 2.0 kilowatts or higher. In an embodiment, the power is on a range up to 15. kilowatt. Moreover, the signal would be modulated using at least one of quantum phase shift key, pulse width modulation, amplitude modulation and pulse position modulation as a data encoding scheme. Other types of modulation may be used to enhance the bit rate of the communication.

In view of these types of signals and, in particular, the signal power, a dangerous condition may occur if the communication channel, for example, cable 106, or downhole metal such as drill string 119, or casing pipe 160 is damaged, disconnected or disturbed. This may generate an electrical signal such as a spark that may ignite potentially explosive gases in addition to the risk of electrical shock or electrocution to attendant personnel.

Figure 2:
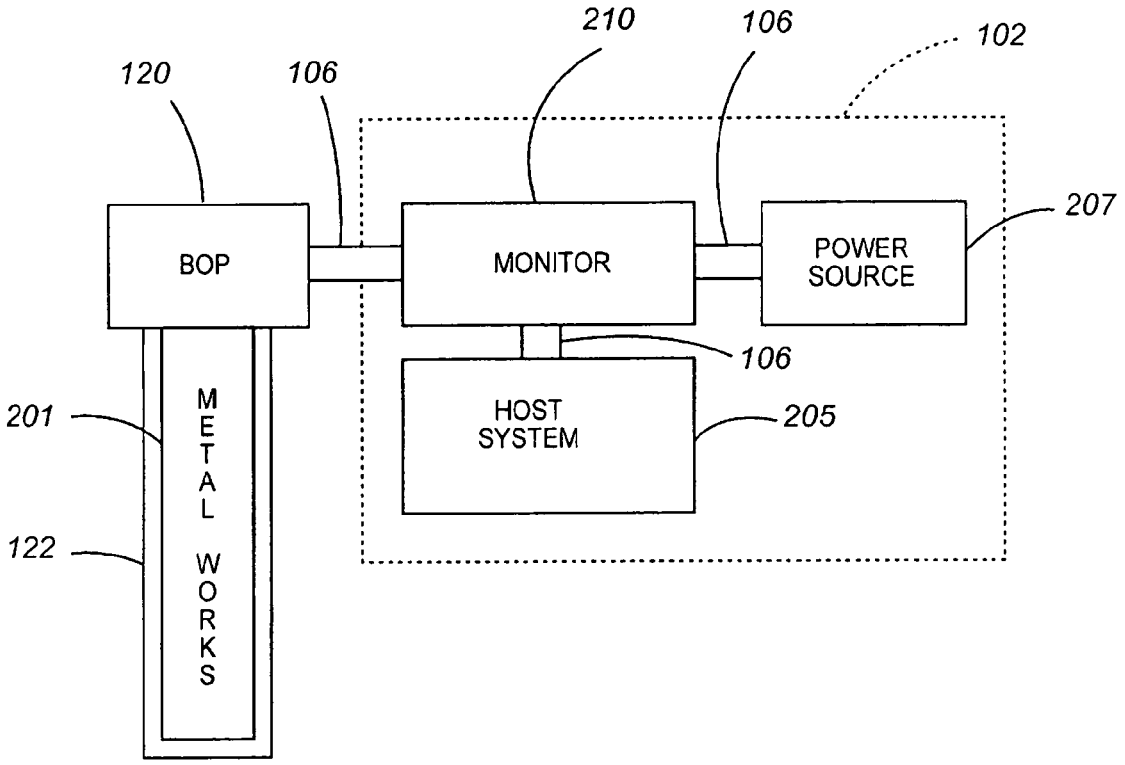
FIG. 2 is a schematic view according to various embodiments of the invention.

FIG. 2 shows a schematic view of an embodiment of the present invention with the electronics 102 connected to the blowout preventor 120, which is connected to the downhole metal work 201. The electronics includes a host system 205 that controls a power source 207, which are both in communication with a signal integrity monitor 210. The host system 205 may include electronic circuitry used in high-speed computers, communication and signal processing circuitry, modems, processor modules, embedded processors, data switches, and application-specific modules, including multilayer, multi-chip modules. Such apparatus and systems may further be included as sub-components within a variety of electronic systems, such as displays, televisions, personal computers, workstations, vehicles, and conducting cables for a variety of electrical devices, among others. Power source 207 provides the power for the signal that is created by the host system 205 and is conducted to the hole site whereat the signal is communicated downhole to downhole tools. In an embodiment, the power source 207 is an analog power amplifier that outputs a signal in up to about 250 kHz with a root mean power of up to 2 kilowatts or higher. In an embodiment, the amplifier outputs a signal of about 1.8 kilowatts. In an embodiment, the power source is similar to an AC audio amplifier for audio listening equipment. In a further embodiment, the power source is a DC amplifier.

The cable signal integrity monitor 210 is connected through physical lines 106 to the host system 205, power source 207, and blowout preventor 120. The lines 106 provide wired communication between these devices. Lines 106 may be housed in a single insulation, for example, coaxially. The lines 106 are adapted to provide a signal path for AC communication signals in the well site environment. The lines 106 are insulated and hardened to prevent damage thereto in this environment. However, the lines may still become damaged in this environment, for example, by workers using tools or other heavy equipment. The monitor 210 senses signals in the lines 106. Based on the sensed signals, the monitor 210 either maintains the steady state, which allows electrical communication in the system, or will disconnect the power source from the communication system in an attempt to minimize stray electrical power in the event of a fault. It is also desirable to minimize false fault detection. Turning off the power will minimize the likelihood that the electrical power, which is needed for metal work communication with downhole equipment, will cause a hazardous situation such as electrical shock or ignition of gases. The cable integrity monitor 210 includes electrical signal detectors. In an embodiment, the monitor includes a resistance sensor to sense a change in resistance in the communication path. In an embodiment, the monitor 210 includes a voltage sensor to sense a change in voltage in the signals in the communication path. In an embodiment, the monitor 210 includes a current sensor to sense a change in current in the communication path. One example of a current sensor includes a current sense amplifier connected to the communication lines 106. The current sense amplifier may include a comparator to compare the sensed signal to a reference signal that represents the signal produced by the host system 205. In an embodiment, the current sense amplifier includes two internal comparators to produce a pulse-width output signal proportional to the current being sensed. In an embodiment, the current sensor includes a hall effect sensor that operated on a non-contact basis by measuring the change in the magnetic field produced by signals in the lines 106.

Figure 3:
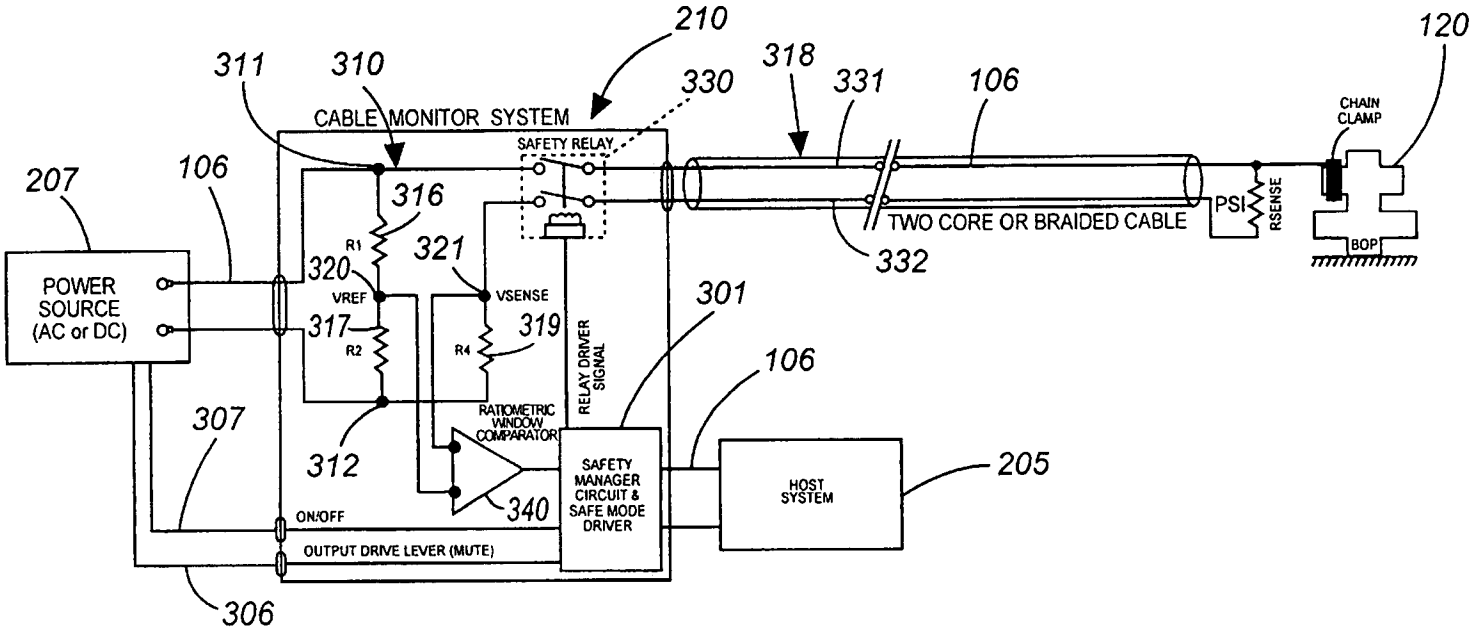
FIG. 3 is a more detailed view according to various embodiments of the invention.

FIG. 3 shows an embodiment of the monitor 210 with connections to the power source 207, host system 205, and blowout preventor 120. In the illustrated embodiment, the communication connections 106 are shown as multiple wires, i.e., two wire connections. However, it will be recognized that a single wire may be used. Monitor 210 includes a safety manager circuit and safe mode driver 301 that is in direct connection with the host system 205. Driver 301 may be implemented as a circuit. In an embodiment, the driver 301 is a software module operating in a processor/memory device. The driver 301 receives a modulated signal from the host system 205 and transmits the signal to the power amplifier 207 over connection 306. Driver 301 further sends an on/off signal over connection 307 to the amplifier 207 to control the state of the amplifier 207. Power amplifier 207 is in an on or off state depending on the signal from the driver 301. The amplifier 307 outputs and amplified signal on connection 106 to inputs of a sensor circuit 310. The sensor circuit determines the integrity of the signal path and further toggles the amplifier to off as well as feedbacks to the host system 205.

The sensor circuit 310 in the illustrated embodiment is a Wheatstone bridge. The bridge has a first input 311 connected to one of the lines 106 and a second input 312 connected to a second of the lines 106. The bridge includes a circuit to determine a reference signal, which includes a first leg 316 in series with a second leg 317. The bridge further includes a second circuit to determine a sense signal, which includes a third leg 318 and a fourth leg 319. Each of legs 316-319 has a predetermined impedance. In an embodiment, each of the legs 316-319 have a known resistance. First leg 316 is between the first input 311 and a reference output 320. Second leg 317 is between the reference output 320 and the second input 312. Third leg 318 is between the first input and the sensed output 321. Fourth leg 319 is between the sensed output 321 and the second input 312. In one embodiment, the third leg includes an electrical line extending from the first input to a relay switch 330. The relay 330 is a circuit breaker in an embodiment. The third leg 318 further includes an electrical line 331 extending from the relay. This electrical line 331 covers essentially the entirety of the distance from the electronics to the well site. In an embodiment, this distance is tens of meters. In an embodiment, this distance is up to about 100 meters. In an embodiment, the length is up to about 125 meters. In yet other embodiments, the length can be equal to or greater than 1,000 meters. That is the length of lines 106, 331 are up to or greater than 1 kilometer. The line 331 is connected to the blowout preventor 120. In an embodiment, line 331 is clamped to an arm of the blowout preventor 120. Adjacent the blowout preventor 120 and distal to the monitor 210, leg 318 includes a known resistance, which is connected to a line 332 that returns to the relay 330 and connects to the sensed output 321. In an embodiment, the lines 331, 332 are housed in a single insulator, dual core cable. In a further embodiment, the lines 331, 332 are in a braided cable. In an embodiment, the lines 331, 332 are separate lines. The reference signal at 320 and the sensed signal 321 are each fed to a comparator 340. Comparator 340 is a ratiometric window comparator. The comparator 340 compares the reference signal to the sensed signal. If there is a certain deviation of the sensed signal from the reference signal, then comparator 340 outputs a signal to the driver 301. Driver 301 then opens the normally closed relay 330 to disconnect the power amplifier 207 from the third leg 318, and hence, the well site. The driver 310 further turns off amplifier 207. Driver 310 signals host system 205 that the communication with the equipment at the well site is down. Additional data related to the shut down can be stored by the host system 205.

It is recognized that the cable 106 is connected to a metal work such as a blowout preventor in the illustrated embodiment. However the invention is not so limited and may be connected to metal work at the surface known to those in the field of wells. The surface level metal work 120 may include one of a pump jack, a nodding donkey or a horsehead pump. In an embodiment, the cable 106 is connected to a conductive stake at the bore hole. In an embodiment, the cable 106 is connected to a pipeline service station. In an embodiment, the cable 106 extends from an offshore platform down to metal work at the borehole.

Figure 4:
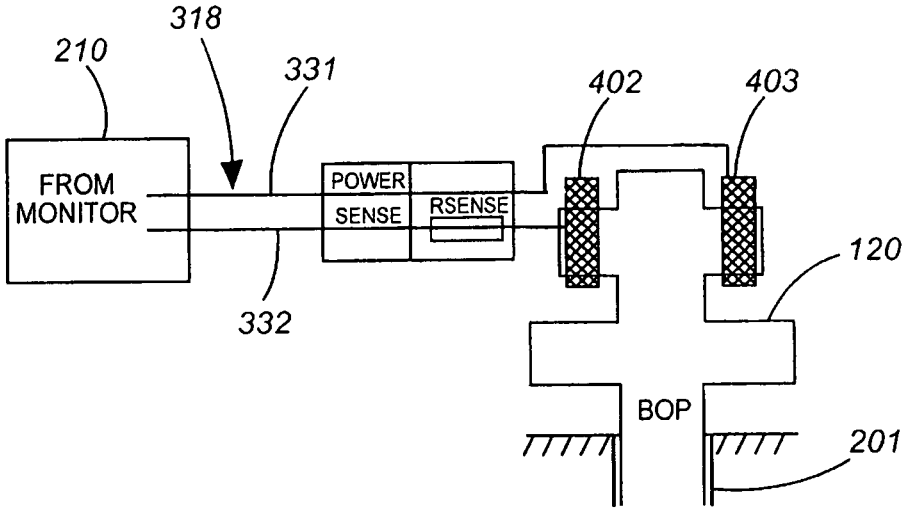
FIG. 4 is a view of connections to a blowout preventer according to an embodiment of the invention.

FIG. 4 shows an embodiment of the connection from the signal monitor 210 to the well site. The signal monitor 310 is electrically connected to the lines 331, 332. Line 331 delivers the modulated power signal that contains the data to be transmitted downhole through the downhole metal work. Line 331 is connected to one side of the blowout preventor 120 by a clamp 402. Line 332 is connected to another side of blowout preventor 120 by a clamp 403. It will be understood that each of lines 331 and 332 could be connected to a single one of clamps 402, 403 in an embodiment. Signals arrive through powered line 331 and enter the blowout preventor 120, which in turn transmits that electrical signal to the downhole metal work 201. Return line 332 feeds the powered signal back through an impedance (e.g., a set sense resistance), to the monitor 210. The set sense resistance is housed such that it is proximal to the well site and protected from the elements and accidental damage.

Figure 5:
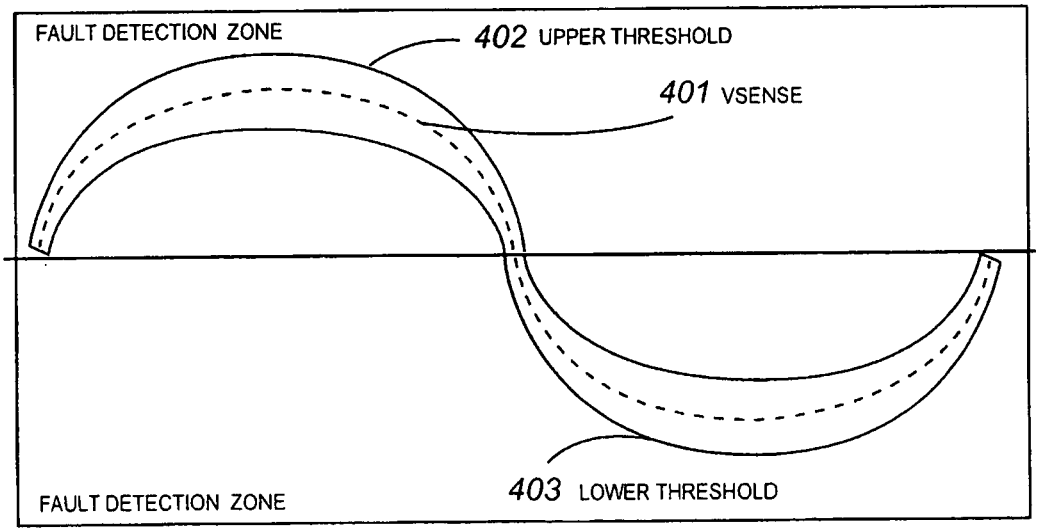
FIG. 5 is a graph showing a fault zone according to an embodiment of the invention.

FIG. 5 shows a graphical representation of an acceptable waveform to provide cable or connection fault detection. The reference signal 401 is shown as a sinusoidal signal in which data is embedded. As the reference signal 401 travels a sinusoidal pattern, an upper threshold limit 402 and a lower threshold limit 403 is determined as a percentage of the reference signal. In an embodiment, the reference signal is a reference voltage. The sensed signal at output 321 is compared to the reference signal, which is at output 320. If the sensed signal exceeds the upper threshold 402 or falls below the lower threshold 403, then a fault is detected. The driver 301 trips the relay and turns off the power amplifier 207.

Figure 6:
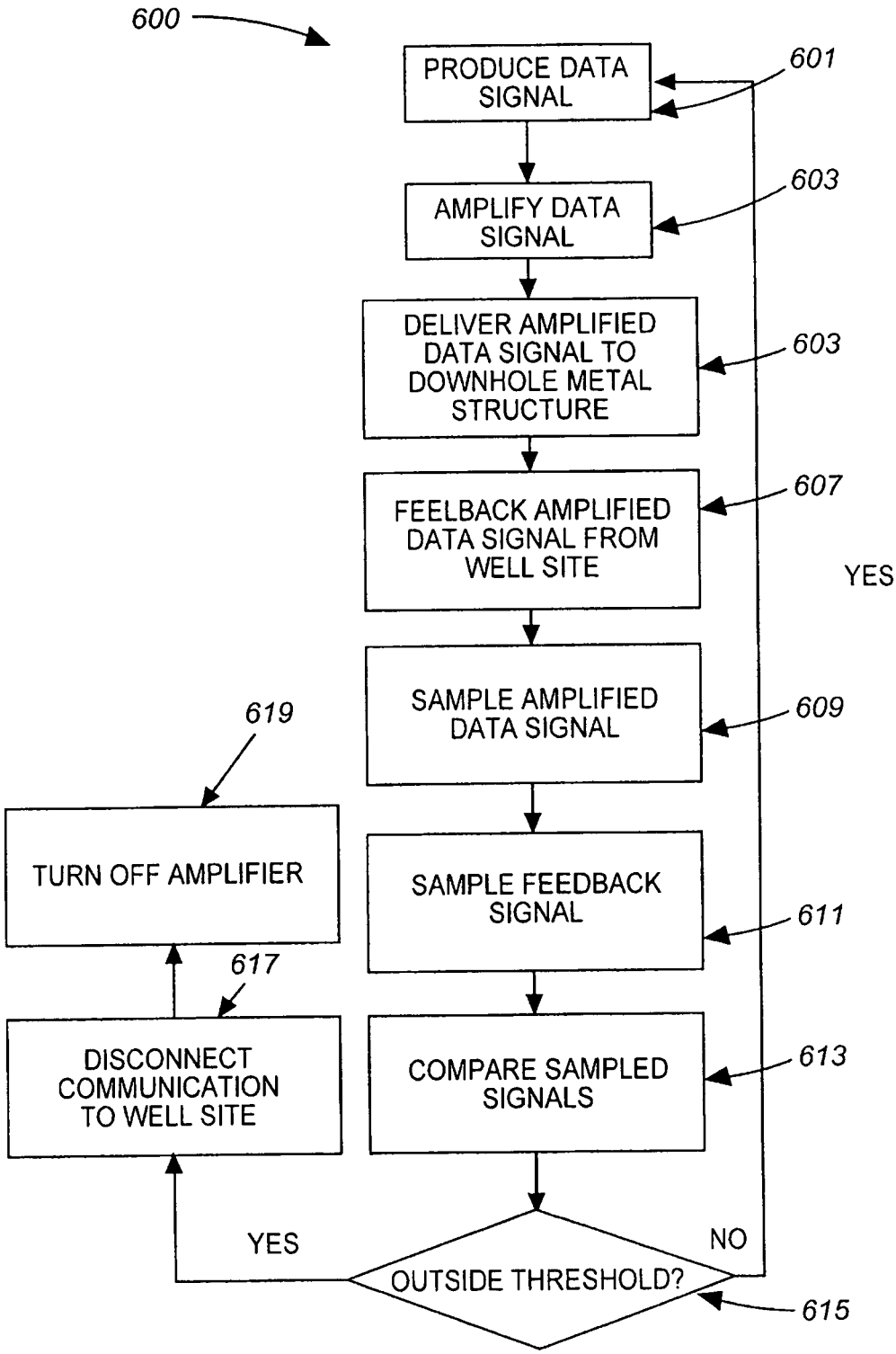
FIG. 6 is a flow chart illustrating a method according to various embodiments of the invention.

FIG. 6 is a flow chart illustrating a method 600 of an embodiment of the present invention. A data signal is produced, 601, which includes a carrier signal that is modulated to include data. The data signal typically does not have sufficient power to transmit through downhole metal work to subsurface tools. The data signal is then amplified, 603, remote of the well site. The amplified signal is delivered to the downhole metal structures, 605, such as drill strings or casing. A portion of the amplified signal is fed back to the location remote of the well site, 607. The amplified data signal is sampled, 609. The feed back signal is sampled, 611. In an embodiment, the sample signals are analog and, hence, the sampling is performed at an analog circuit, such as a bridge circuit. In an embodiment, the sampled signals are digitally sampled. In a further embodiment, the sampling is performed at an analog circuit, such as bridge. The sampled signals are compared, 613. This comparison is done in the digital domain when digitally sampled or using an analog comparator circuit if in an analog domain. If the sampled signals are within a range or threshold 615, then the method continues, i.e., returns to step 601. However, many of these steps can occur simultaneously. If the comparison shows that the feedback signal deviates from the reference amplified signal outside the threshold, then the power amplifier is disconnected from communication with the well site, 617. The amplifier is also turned off based on the comparison, 619.

Figure 7:
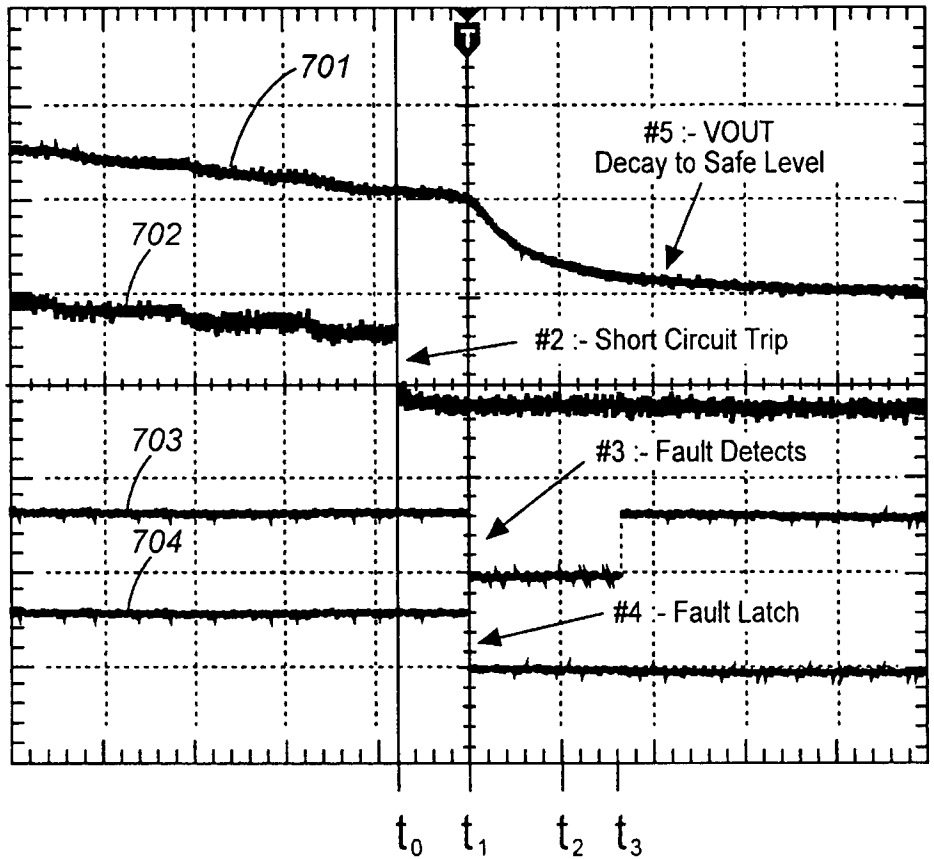
FIG. 7 is a waveform captured according to an embodiment of the invention.

FIG. 7 shows a data graph that illustrates the operation of the presently described structures, apparatus and methods. Waveform 701 shows an output waveform, which is a portion of sine wave that is applied at the well site. In an embodiment, the signal is a 30 volt peek to peek, 11.5 Hz signal. Waveform 702 represents the signal over the third leg of the bridge, sensing circuit. Waveform 703 represents the output from the comparator. Waveform 704 represents a fault latch signal in the driver. A brief description of the operation follows. At time to a short circuit trip occurs, see waveform 702. A short circuit fault may occur when the power line 331 and the sense line 332 are electrically connected together other than through the metal work 120. This can occur when a cable that includes the power and sense lines 331, 332 is squashed together or otherwise damaged. The value at leg 318 goes to a low impedance value. In an example, the leg 318 goes to a low impedance at time $t_1$ as shown in FIG. 7. The bridge circuit 310 goes imbalanced, which causes the comparator to generate a fault signal. Returning to FIG. 7, at time $t_1$, the fault is detected in the signal monitor 210, see waveform 703. The fault is latched in the monitor 210, see waveform 704. The driver 106 trips, i.e., opens the normally closed, relay 330. The electrical power at the well site is no longer powered by the electronics based on the open relay. The power at the well site begins to decay at time $t_1$. The time period between to and $t_1$ is less than one millisecond. In an embodiment, the time period between the short and the sensing of the short is about 800 microseconds. The power at the well site decays rapidly to about 20% of its power at $t_1$ by time $t_2$. The power in signal 701 begins to decay before the power amplifier is turned off. At time $t_3$, the fault detector signal 703 returns to a no-fault state. However, the fault state is latched in waveform 704, which will not allow the communication through relay 330 to reset without resetting the fault latch. The fault latch is reset after personnel inspect the communication system including all lines, wires, cables, and connections. As shown in this embodiment, the fault signal is a digital signal.

The present system 100 may further detect an open circuit fault, which will generate similar waveforms. An open circuit fault is where the Rsense portion of leg 318 is no longer connected to the bridge 310. In an embodiment, the leg 318 is not electrically connected to the remainder of the bridge. The bridge 310 will become imbalanced and signal the comparator. The comparator will signal the driver 301 that a fault has occurred. More specifically, waveform 703 will show a fault. Waveform 704 will latch the fault. Waveform 701 will decay shortly after the fault is detected.

The present description refers to on shore structures examples. It will be recognized that the embodiments of the present invention are adaptable to monitor the integrity of offshore cables.

It should be noted that the methods described herein do not have to be executed in the order described, or in any particular order. Moreover, various activities described with respect to the methods identified herein can be executed in iterative, serial, or parallel fashion. Information, including parameters, commands, operands, and other data, can be sent and received in the form of one or more carrier waves.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A hydrocarbon extraction apparatus, comprising:

a metal casing extending subsurface;

a blowout preventor connected to the casing;

a downhole communication unit in electrical communication with the metal casing;

an electrical transmission cable connected to at least one of the blowout preventor and the metal casing;

a surface communication unit in electrical communication with the downhole communication unit;

wherein the surface communication unit is configured to transmit a power signal modulated with data to the downhole communication unit; and a signal monitor that comprises a comparator circuit connected to the surface communication unit and the transmission cable, the signal monitor to disconnect the surface communication unit from the transmission cable if a fault is detected in electrical communication between the surface communication unit and the downhole communication unit.

2. The apparatus of claim 1, wherein the surface communication unit includes a power amplifier to produce at least a one kilowatt signal.

3. The apparatus of claim 2, wherein the signal monitor includes a signal sensor, and a circuit breaker to receive operatively coupled to the signal sensor and to selectively disconnect the power amplifier from the transmission cable.

4. The apparatus of claim 3, wherein the signal sensor includes a bridge comprising a known first resistance, a known second resistance, a known third resistance, and a known fourth resistance.

5. The apparatus of claim 4, wherein the third resistance is adjacent the blowout preventor, and wherein the first resistance, the second resistance, and the fourth resistance are remote to the blowout preventor.

6. The apparatus of claim 5, wherein a sensed signal is sensed intermediate the third resistance and the fourth resistance, and wherein a reference signal is sensed intermediate the first resistance and the second resistance.

7. The apparatus of claim 6, wherein the signal monitor includes a comparator to receive the sensed signal and the reference signal.

8. A method for monitoring communication at a hydrocarbon extraction site, comprising:

transmitting an electrical power signal modulated with data from a surface device to a downhole device;

monitoring the integrity of a communication path between the surface device and the downhole device by sensing the modulated power signal with a comparator circuit; and if the sensed signal deviates from a reference signal, disconnecting power from the communication path.

9. The method of claim 8, wherein transmitting includes power amplifying an electrical signal to at least one kilowatt.

10. The method of claim 9, wherein transmitting includes transmitting the electrical signal through a length of cable to a blowout preventor and downhole through metal work.

11. The method of claim 10, wherein monitoring includes sensing a reference signal remote from the extraction site.

12. The method of claim 11, wherein monitoring includes positioning a resistance adjacent to the blowout preventor.

13. The method of claim 12, wherein monitoring includes determining a reference signal remote to the blowout preventor and determining a sensed signal remote to the blowout preventor.

14. The method of claim 12, wherein monitoring includes comparing the sensed signal to the reference signal.

15. The method of claim 14, wherein disconnecting power includes opening a relay based on a result of the comparing.

* * * * *